United States Patent [19]

Larson

[11] 3,950,811

[45] Apr. 20, 1976

[54] SWEEPER ATTACHMENT FOR A FACTORY FORK LIFT TRUCK

[75] Inventor: Harold J. Larson, Williston Park, N.Y.

[73] Assignee: The Raymond Lee Organization, Inc., New York, N.Y.

[22] Filed: July 7, 1975

[21] Appl. No.: 593,828

[52] U.S. Cl. ..... 15/49 C; 15/83

[51] Int. Cl.[2] ..... E01H 1/04; A47L 11/24

[58] Field of Search ..... 15/49 C, 79 R, 83, 98; 280/43 R, 43.17

[56] References Cited

UNITED STATES PATENTS

| | | | |
|---|---|---|---|
| 3,354,489 | 11/1967 | Ehrlich | 15/49 C X |
| 3,568,232 | 3/1971 | Swanson | 15/83 |

*Primary Examiner*—Edward L. Roberts

*Attorney, Agent, or Firm*—Howard I. Podell

[57] ABSTRACT

A floor sweeping attachment attachable to the underside of a factory fork lift truck. The device is in the form of a rectangular frame mounted on wheels to which a rotary brush sweeper unit is fastened. The wheel units of the frame are each mounted on a rotatable vertical pin, slidably fitted in a vertical tube of the frame. A pair of tapered wheels are fastened to the upper section of each wheel unit and ride under and lift up the frame when the device is moved sidewise to lift the brush sweeper unit above the floor level so as to avoid wearing of the brush bristles and brush sweeper wheels when the attached lift truck is not moving in a general forward or rearward motion.

2 Claims, 4 Drawing Figures

SWEEPER ATTACHMENT FOR A FACTORY FORK LIFT TRUCK

SUMMARY OF THE INVENTION

My invention is a floor sweeper attachment which mounts on the undercarriage of a factory fork lift truck.

An advantage of my invention is that it is readily adaptable for use with a conventional fork lift truck.

The brushes of the sweeper device are driven by the rotation of the wheels of the sweeper device, when the invention is attached in an underframe to a moving fork lift truck and the wheels and brushes of the sweeper device require no external power source. When the attached lift truck moves in a sidewise direction, the sweeper device is lifted out of contact with the floor surface so as to avoid undue wear on the brushes and brush sweeper wheels from such sidewise motion.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
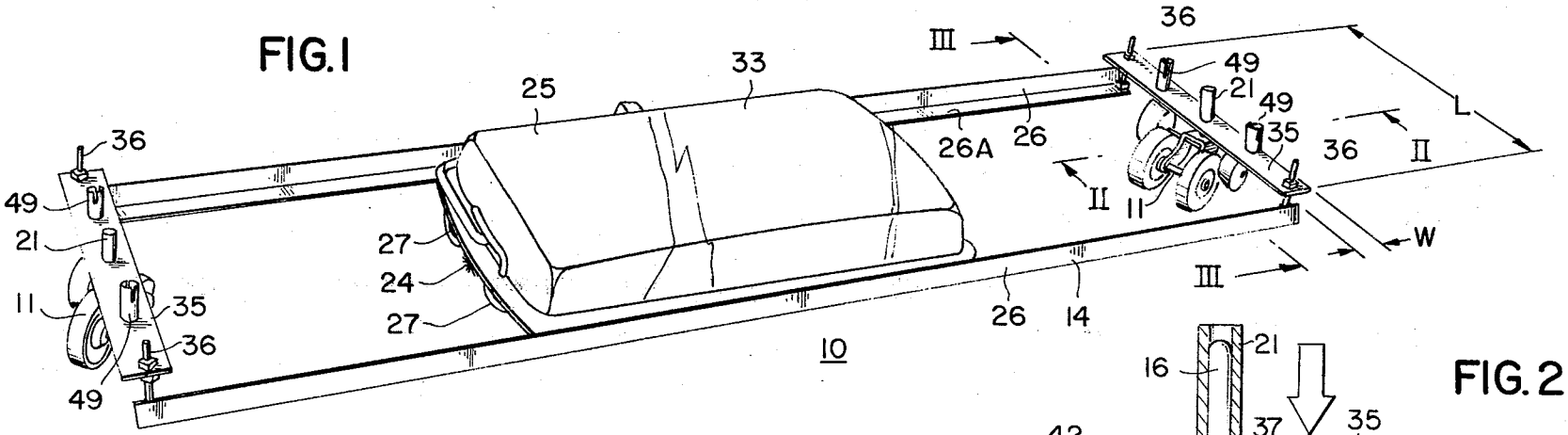
FIG. 1 is a perspective view of the floor sweeper attachment.

Turning now descriptively to the drawings, in which similar reference characters denote similar elements throughout the several views, FIG. 1 illustrates the sweeper attachment 10 which may be mounted under a fork lift truck between the forward and rear truck wheels with the sweeper attachment 10 brushing and cleaning the floor as the truck operates with or without a load on its forks.

The attachment unit 10 incorporates an underframe 14 supported by a pair of caster wheel units 11, which may utilize one or two wheels 12 rotatably mounted in an axle 13 joined to a bracket 44 fixed to a vertical caster pin 16.

Caster pin 16 is mounted in a vertical tube 21 fixed to the underframe 14 so that each caster pin 16 and associated wheel unit 11 may rotate in the horizontal plane and slide vertically with respect to underframe 14 in the installed position of underframe 14 under a lift truck.

A sweeper unit 25 is fitted to frame members 26 of underframe 14 so that the wheels 27 of sweeper unit 25 may contact the floor surface in one position of the caster wheel unit 11 with respect to underframe 14. With wheels 27 of sweeper unit contacting the floor surface and the attached lift truck moving in a direction in the plane of wheels 27, forward or rearwards, wheels 27 rotate and rotate a sweeper brush 24 to sweep dust into the container 33 of the sweeper unit 25. Frame members 26 may be channels spaced apart a suitable distance so that the sweeper unit 25 rests freely on the flanges 26A of frame members 26.

Lift trucks to which the device 10 may be attached frequently move at a sharp angle sidewise to their longitudinal axis and such sidewise motion would wear the brush 24 and sweeper wheels 27 to an excessive degree if the sweeper unit 25 were not lifted above contact with the floor surface during such periods of sidewise motion of the lift truck.

Figure 2:
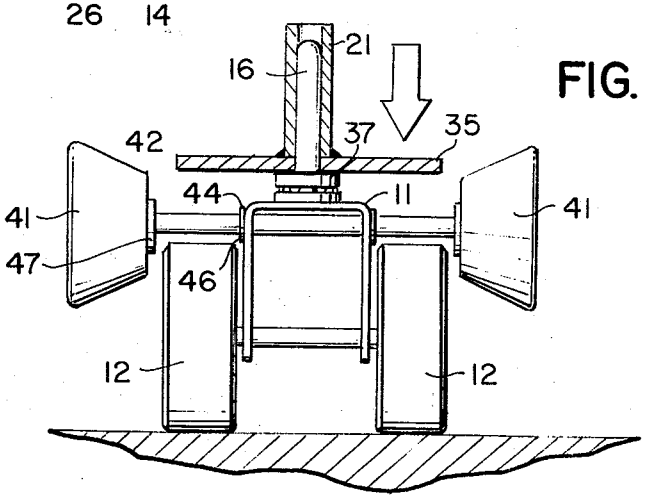
FIG. 2 is an elevation view of the wheels of the sweeper attachment frame, with the frame oriented to move perpendicular to line II—II of FIG. 1.

Each caster wheel unit 11 is mounted underneath a flat strip 35 that serves as a side of the underframe 14 and is mounted by screws 36 to the channels 14 of the underframe 14 so that the height of each side strip 35 may be adjusted relative to the flanges 26A on which the sweeper unit 25 rests to compensate for wear of caster wheels or brush wheels. The pin 16 of each caster wheel unit 11 is slidably and rotatably mounted in vertical tube 21 fixed to strip 35 with strip 35 resting on torque bearing plate 37 fixed to pin 16 to support underframe 14 when the longitudinal axis of strip 35 is oriented in the direction of motion of the underframe 14 and attached lift truck, as shown in FIG. 2.

Strip 35 is of rectangular shape with its width W considerably less than its length L, and less than the spacing between tapered wheels 41 mounted to the caster wheel unit 11. Tapered wheels 41 are mounted to an axle 42 fastened to the bracket 44 between two caster wheels 12 and the torque bearing plate 37, so that tapered wheels 41 may freely rotate independently of caster wheels 12, with axle 42 fitted with bearing plates 46 and 47 to maintain each tapered wheel 41 a uniform distance from the axis of vertical caster pin 16. Each tapered wheel 41 is shaped so that the outer wheel diameter increases with increasing distance from bracket 44 and pin 16.

Figure 3:
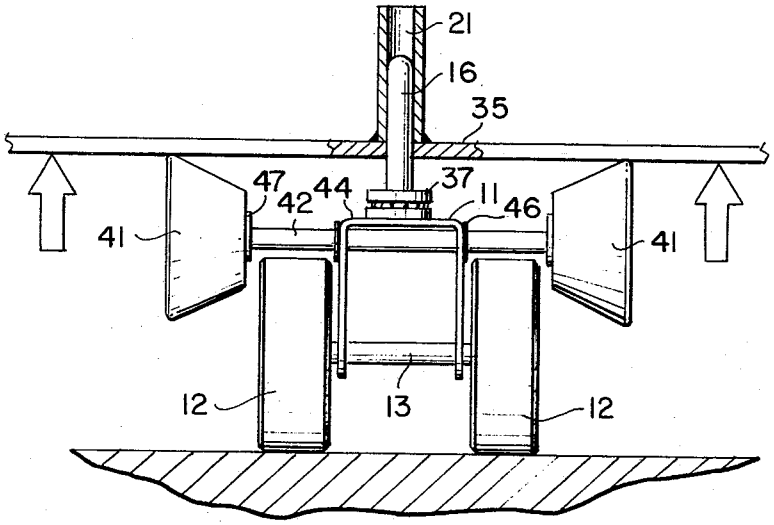
FIG. 3 is an elevation view of the wheels of the sweeper attachment frame, with the frame oriented to move perpendicular to line III—III of FIG. 1.

When the attachment underframe 14 is dragged sidewise at an angle to the longitudinal axis of strip 35, pin 16 and wheel unit 11 rotate so that the plane of caster wheels 12 remain in the direction of motion of frame 14. Rotation of wheel unit 11 causes tapered wheels 41 to ride into and under the strip 35 so as to elevate strip 35 and attached underframe 14, raising strip 35 as shown in FIG. 3, and elevating sweeper unit 25 and its wheels 27 from contact with the floor surface. Thus sweeper unit 25 is lifted from contact with the ground or floor surface whenever the attached lift truck proceeds in a sidewise direction, with strip 35 becoming free of engagement with tapered wheels 41 when the motion of underframe 14 becomes oriented parallel to the longitudinal axis of strip 35, and consequently dropping to the lower position shown in FIG. 2.

The sweeper unit 25 may be fitted with hinged covers on the underside of the unit 25 which may be opened to remove the entrapped grit collected by the sweeper brush 24. Oil pads may be mounted on the interior surface of the covers to collect dust that otherwise might escape from the sweeper housing after being picked up by the sweeper brush 24.

It is to be noted that underframe 14 may be fitted with two or four sets of caster wheel units 11. When two sets of caster wheel units are employed, the pin 16 of each caster wheel unit 11 is fitted into a central vertical tube 21, as shown in FIGS. 1–3. When four sets of caster wheel units 11 are employed, each of the pins 16 of a caster wheel unit is mounted in a vertical tube 49 of strip 35. Underframe 14 may be attached by screws 36 or by vertical pins 49 to the underside of any shop or road vehicle.

Figure 4:
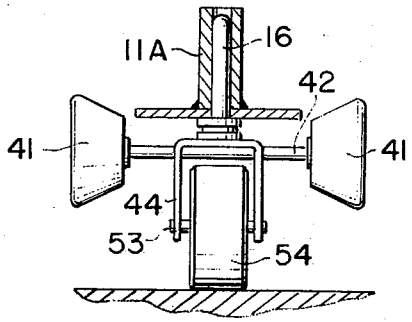
FIG. 4 is an elevation view of an alternate embodiment of the wheels using a single caster wheel.

Alternately, as shown in FIG. 4, one caster wheel 54 may be fastened to each caster wheel unit 11A, with axle 53 being fastened to bracket 44.

Attachment unit 10 is fitted with brackets (not shown) fixed to strips 35 for fastening to the underframe or chassis of a fork lift truck or other vehicle, with such brackets shaped to fit the requirements of the vehicle to which the unit 10 is to be fastened.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device attachable to the undersides of a vehicle for sweeping the surface on which the vehicle travels comprising a frame fitted with a sweeper brush rotatably linked to wheels which rotate the brush when the said wheels are rotated, said frame mounted on a plurality of free swiveling caster wheel units, together with means to elevate the frame and the sweeper brush when the caster wheel units swivel to orient the caster wheels in a plane at an angle to the plane of the wheels linked to the sweeper brush.

2. The combination as recited in claim 1 in which each caster wheel unit is fitted with a pair of tapered wheels fixed on an axle that is rotatably mounted to the caster wheel unit and located between the caster wheels of the caster wheel unit and the attached frame, said tapered wheels spaced apart from each other so as to be free of engagement with the frame in a first position of the caster wheel unit, but to ride under and elevate the frame when the caster wheel unit is rotated at an angle from its orientation in said first position, said caster wheel unit being fitted with a pin that rides freely in a tube fixed to the frame.

* * * * *